United States Patent [19]

Shan

[11] Patent Number: 4,515,492

[45] Date of Patent: May 7, 1985

[54] WRITING IMPLEMENT AND KIT

[76] Inventor: Chen J. Shan, No. 2, Chung-Nei Rd., Cho-Yun Village, Yuan-chang, Hsiang, Yun-Lin Hsien, Taiwan

[21] Appl. No.: 499,940

[22] Filed: Jun. 1, 1983

[51] Int. Cl.[3] ..... B43K 31/00; B43K 29/20

[52] U.S. Cl. ..... 401/52; 206/224; 401/34; 401/88; 401/92

[58] Field of Search ..... 401/17, 19, 20, 34, 401/36, 44, 90, 52, 57, 88, 92, 82; 206/224

[56] References Cited

U.S. PATENT DOCUMENTS

| | | | |
|---|---|---|---|
| 297,041 | 4/1884 | Ward | 401/29 |
| 2,497,950 | 2/1950 | Lohr et al. | 401/88 X |
| 3,790,291 | 2/1974 | Hung et al. | 401/57 |

FOREIGN PATENT DOCUMENTS

| | | | |
|---|---|---|---|
| 42913 | 3/1888 | Fed. Rep. of Germany | 401/34 |
| 817413 | 8/1951 | Fed. Rep. of Germany | 401/82 |
| 798472 | 5/1936 | France | 401/34 |
| 978585 | 4/1951 | France | 401/17 |
| 495796 | 6/1954 | Italy | 401/34 |

*Primary Examiner*—Steven A. Bratlie
*Attorney, Agent, or Firm*—Dowell & Dowell

[57] ABSTRACT

A writing kit which includes a writing implement having an elongated barrel with collets at each end and a push rod extending therebetween wherein each collet is of a different size and has an internal conical surface for cooperatively engaging and gripping a tapered portion of a writing element such as a lead which is shaped having two such portions so that one portion is exposed for writing or drawing while the other is retained within the barrel. The leads may be selectively removed from the collets by operation of the push rod and may be stored in a stand designed to retain a plurality of varying sizes of leads.

4 Claims, 8 Drawing Figures

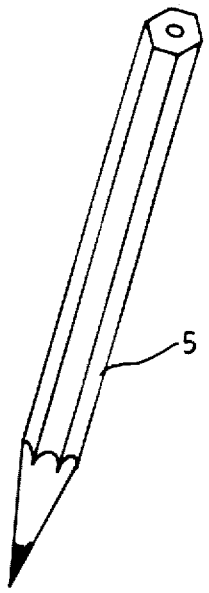
FIG 6-A
PRIOR ART

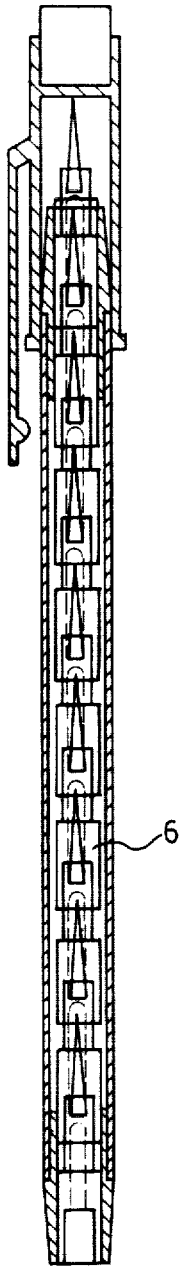
FIG.6-B
PRIOR ART

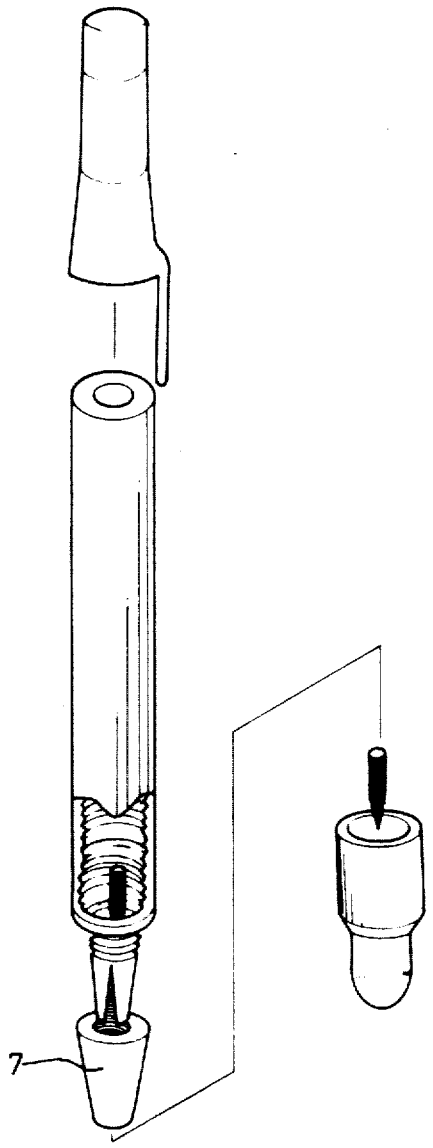
FIG6-C
PRIOR ART

WRITING IMPLEMENT AND KIT

BACKGROUND OF THE INVENTION

History of the Prior Art

There are many conventional designs for both mechanical and wooden pencils in the prior art. However, there are a number of problems associated with their use.

With reference to FIG. 6-A a conventional wooden pencil is shown. Such pencils often need sharpening in order to maintain their lead portions in proper condition for writing or drawing and are often unable to be fully utilized due to improper sharpening techniques. Further, it is often necessary to use a number of wooden pencils having differing lead thicknesses or hardnesses if desired to achieve different writing, lining, shading or other drawing characteristics.

Various drawbacks are also associated with other conventional pencils having a series of interchangeable points, such as shown in FIG. 6-B. Often, if one of the writing elements of the pencil is lost, the entire pencil may become unusable. Also, the foremost or tip writing element of the pencil is often unstable during use; hence, it is not always possible to have good writing or drawing results using such a pencil.

Conventional mechanical pencils such as shown in FIG. 6-C are also not completely satisfactory. In some instances the collet used to grip the lead may be easily damaged.

It is, therefore, an object of the present invention to provide a writing pencil and kit which may be used to overcome some of the problems encountered utilizing prior art pencils.

SUMMARY OF THE INVENTION

This invention is directed to a writing kit including a plurality of pencil leads which may be of varying sizes and which are formed so as to have conical points on each end thereof and which are selectively receivable within one of a pair of oppositely oriented conically shaped collets of a writing implement. In addition to the collets which form lead receiving openings of different sizes at the ends of the writing implement, a push rod assembly is disposed within the implement by way of which the pencil leads may be urged from seated engagement with either of the collets.

It is a primary object of the present invention to provide a pencil which does not need sharpening but wherein leads may easily be replaced or substituted.

It is another object of the present invention to provide a writing kit which is versatile and economical.

It is still another object of the present invention to provide a writing kit in which the writing elements are retained more securely by the writing implement so that the elements are not movable during use.

It is a further object of the present invention to provide a writing kit which may be used even if some of its writing elements or leads are lost.

It is still a further object of the present invention to provide a writing kit which may be equipped with different kinds and sizes of writing elements or leads.

It is still a further object of the present invention to provide a writing kit having a writing implement with oppositely oriented writing element receiving collets which are adapted to receive various sizes of writing elements.

Other objects and a fuller understanding of the present invention may be had by referring to the following detailed description taken in conjunction with the accompanying drawings.

BRIEF DESCRIPTION OF THE DRAWINGS

FIG. 6-A is a perspective view of a conventional prior art wooden pencil.

FIG. 6-B is a sectional view showing a known prior art pencil which does not need sharpening.

FIG. 6-C is a fragmentary perspective view of a known prior art mechanical pencil.

DETAILED DESCRIPTION OF THE PREFERRED EMBODIMENT

Figure 1:
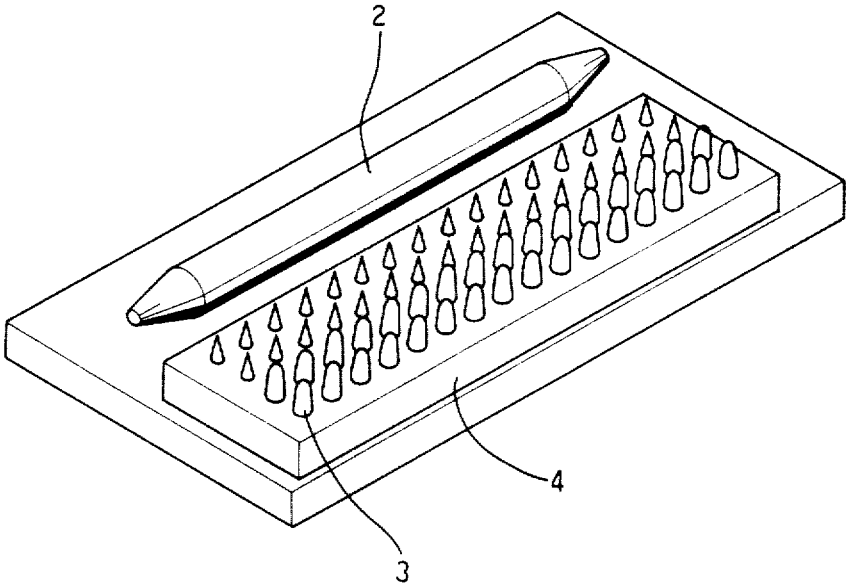
FIG. 1 is a perspective view of a writing kit according to the present invention.

Referring now to FIG. 1, there is shown a perspective view of a writing kit according to the present invention. As shown, the writing kit comprises a plurality of leads 3, a writing implement 2 and a stand 4. The leads 3 are inserted into the stand 4 so that the leads 3 will not drop out even if the stand 4 is impacted or overturned. The writing kit is of a size which makes it compatible for storage in most of the pencil cases currently available.

Figure 2:
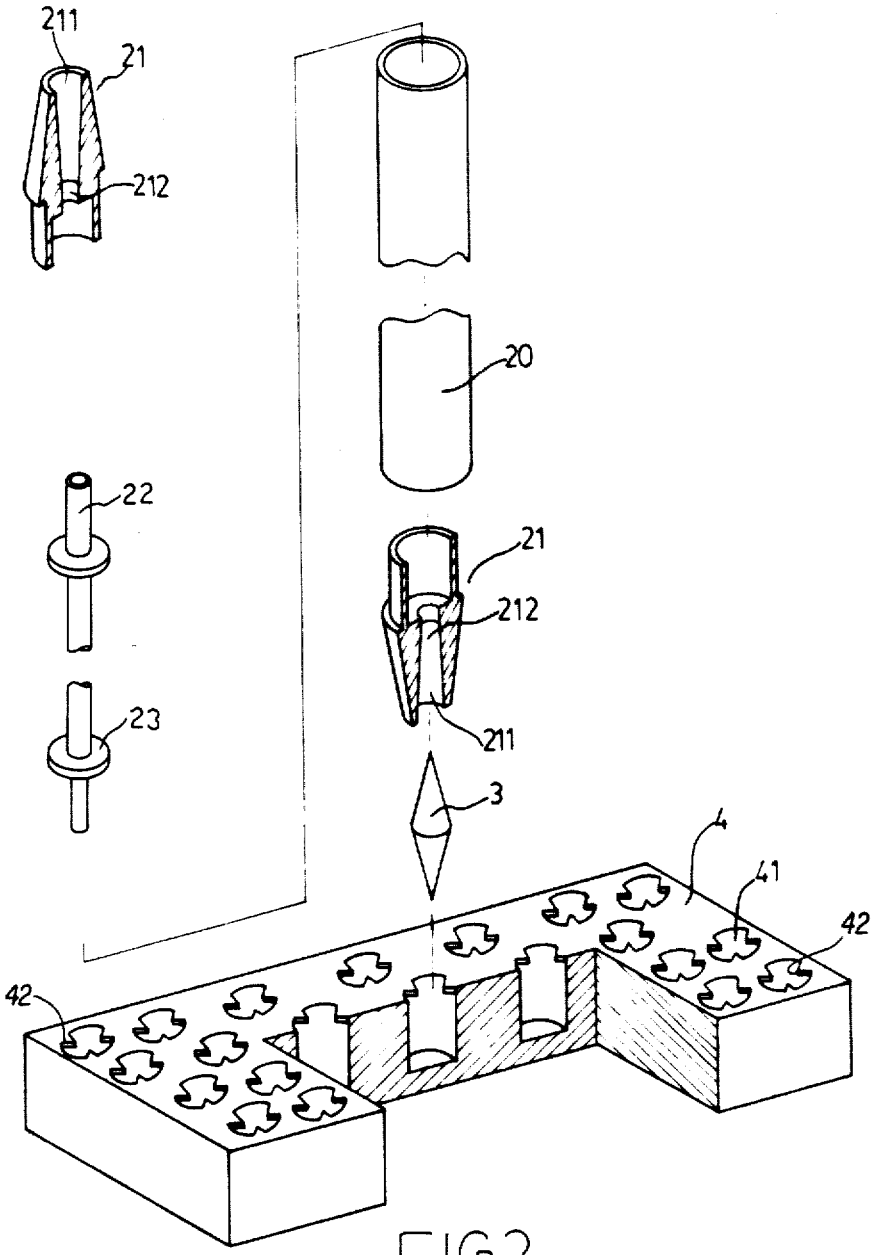
FIG. 2 is a fragmentary perspective view of the writing kit and writing implement according to the present invention.

Referring to FIG. 2, the writing implement 2 comprises an elongated barrel 20, two collets 21 and a push rod 22. The elongated barrel 20 is a hollow tube, each end of which is equipped with a collet 21. The inside diameter of one of the collets is different from the other one of the collets. Each of the collets 21 is provided with a substantially conical internal surface 211 which defined a conical hole or opening. A straight hole 212 is provided at one end of the conical hole so as to communicate the conical hole or opening with the interior of the hollow tuble. The wall or surface of the conical hole 211 is used to closely engage one of the leads 3 while the straight hole 212 is used to permit the passage of the push rod 22. The push rod 22 is a hollow rod on which are mounted two rings 23 for limiting the movement of the push rod 22 within the elongated barrel 20 thereby preventing the push rod 22 from being axial displaced therefrom. Each of the leads 3 is provided with a pair of tapered end portions which taper from a central portion to two opposite points so that either end thereof may be used to write or draw.

Figure 3:
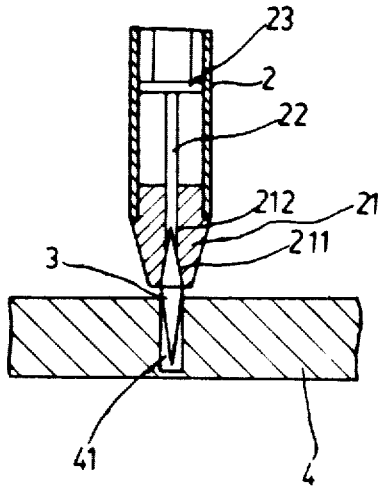
FIG. 3 is a sectional view showing the operation of the writing kit and writing implement according to the present invention.

Referring to FIG. 3, the loading of a lead into a collet of the writing implement is shown in detail. The leads 3 are normally inserted into the stand 4. To remove a lead 3 from the stand 4, it is only necessary to engage one of the collets 21 with one of the leads 3. Since the collets 21 and the leads 3 have conical surfaces, the lead 3 can be tightly fitted into the collet 21. Either of the collets 21 may be engaged with one of the leads 3. In other words, the writing implement 2 may selectively be equipped with one of two kinds of leads with different diameters. To remove the lead 3 from the writing implement 2, the push rod 22 is pressed to push the lead 3 out of the elongated barrel 20.

As shown in FIGS. 1, 2 and 3, the stand 4 is formed with a plurality of holes 41 in which the leads 3 are disposed. Each of the holes 41 is equipped with a number of flexible protuberances 42 for preventing the leads 3 therein from accidentally being displaced therefrom but which permit the leads 3 to be selectively removed after being engaged with one of the collets 21.

Figure 4:
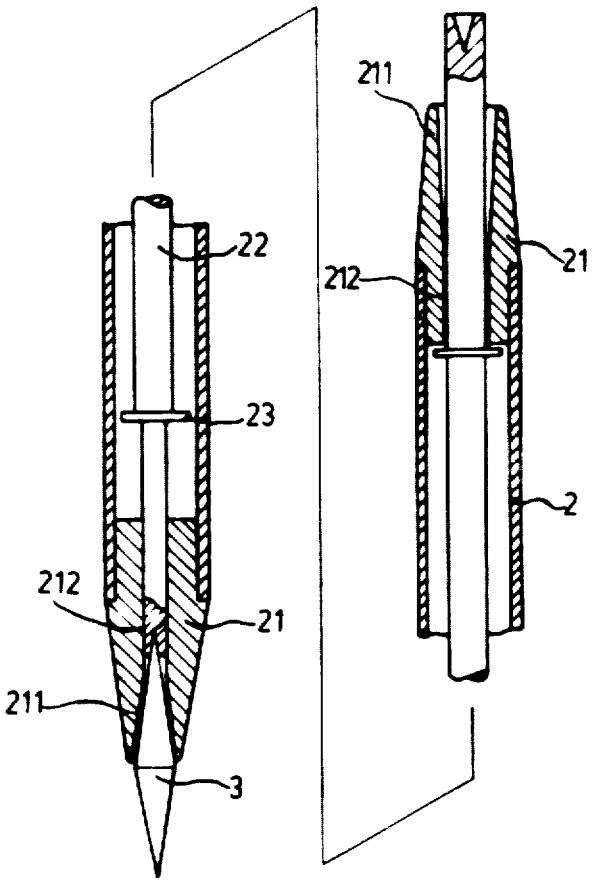
FIG. 4 is a sectional view of the writing implement of the writing kit according to the present invention.
Figure 5:
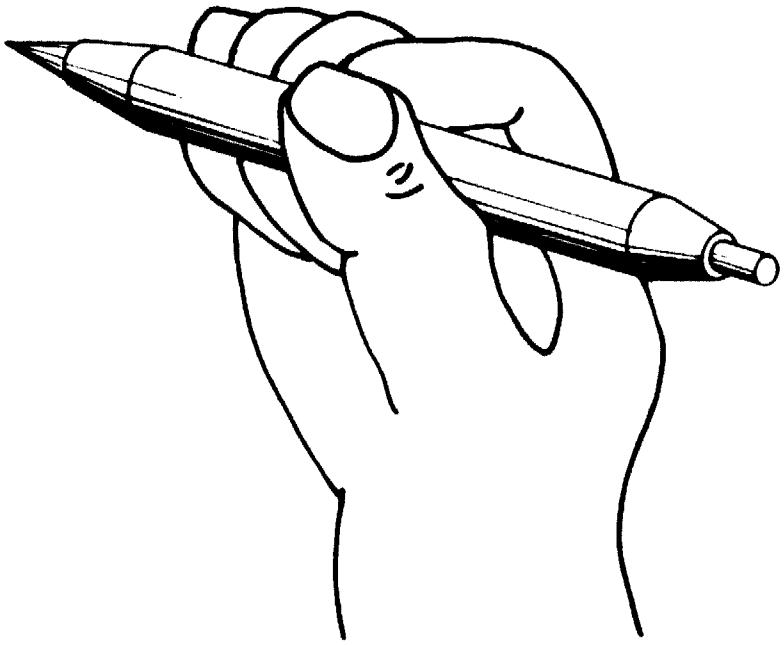
FIG. 5 is an illustrative view showing how the writing implement according to the present invention is handling during use.

In FIG. 4, a sectional view of the writing implement of the writing kit is shown according to the present invention. When a lead 3 is fitted into one of the collets 21, the push rod 22 will be pushed upwardly by the lead 3 so as to protrude from the opposite collet as the push rod 22 will be moved axially of the barrel a length equal to the distance which the lead 3 has been extended into the collet. Thus, only one of the collets 21 is used to engage one of the leads 3 at a time.

Although this invention has been described in its preferred form with a certain degree of particularity, it is understood that the present disclosure has been made only by way of example, and that numerous changes in the details of construction and the combination and arrangement of parts may be made without departing from the spirit and scope of the invention as hereinafter claimed.

I claim:

1. A writing kit comprising, a plurality of leads each having a pair of tapered portions tapering from the central portion toward two opposite points, a stand having a plurality of holes therein for selectively receiving said leads, a writing implement including an elongated barrel having an opening therethrough and opposite ends, a pair of collet means engaging said ends of said elongated barrel so as to be oppositely oriented with respect to one another, each of said collet means having a conical internal surface for engaging and gripping said tapered portions of said leads and having an opening therein which is generally aligned with said opening through said elongated barrel, a push rod means disposed within said elongated barrel and being movable through said opening in said collet means, said push rod means having means for limiting the movement of said push rod means within said elongated barrel, and with respect to each of said opposite ends thereof, said push rod means being operable to urge a lead from engagement with either of said collet means.

2. The writing kit of claim 1 in which each of said holes in said stand includes a number of flexible protuberances which extend inwardly thereof for engaging said leads which are selectively received therein.

3. The writing kit of claim 2 in which said push rod means includes an elongated shaft having opposite ends, said means for limiting the movement of said push rod means within said elongated barrel including a pair of spaced ring members which are mounted to a shaft adjacent to and inwardly of said ends thereof.

4. The writing kit of claim 1 in which the size of said conical internal surface for engaging and gripping said tapered portions of said leads of one of said collet means is of a different dimension than said conical internal surface of the other of said collet means.

* * * * *